US005248317A

United States Patent [19]

Tank et al.

[11] Patent Number: 5,248,317

[45] Date of Patent: Sep. 28, 1993

[54] METHOD OF PRODUCING A COMPOSITE DIAMOND ABRASIVE COMPACT

[76] Inventors: Klaus Tank, 9 Warbleton Avenue, Essexwold, Johannesburg, Transvaal; Peter N. Tomlinson, 315 Enford Road, Mondeor, Johannesburg, Transvaal; Trevor J. Martell, 8 Erica Place, Vale Road, Weltevreden Park, Transvaal, all of South Africa

[21] Appl. No.: 766,443

[22] Filed: Sep. 26, 1991

[30] Foreign Application Priority Data

Sep. 26, 1990 [ZA] South Africa ..... 90/7690

[51] Int. Cl.[5] ..... B24D 3/00

[52] U.S. Cl. ..... 51/293; 51/295; 51/303; 51/309

[58] Field of Search ..... 51/293, 295, 303, 309

[56] References Cited

U.S. PATENT DOCUMENTS

| | | | |
|---|---|---|---|
| 3,745,623 | 7/1973 | Wentorf, Jr. et al. | 29/95 B |
| 4,311,490 | 1/1982 | Bovenkerk et al. | 51/307 |
| 4,403,015 | 9/1983 | Nakai et al. | 428/565 |
| 4,496,372 | 1/1985 | Almond et al. | 51/309 |
| 4,505,721 | 3/1985 | Almond et al. | 51/309 |
| 4,789,385 | 12/1988 | Dyer et al. | 51/293 |
| 4,802,895 | 2/1989 | Burnand et al. | 51/293 |
| 4,959,929 | 10/1990 | Burnand et al. | 51/307 |
| 5,009,673 | 4/1991 | Cho | 51/293 |
| 5,032,147 | 7/1991 | Frushour | 51/309 |

*Primary Examiner*—Mark L. Bell
*Assistant Examiner*—Willie J. Thompson
*Attorney, Agent, or Firm*—Scully, Scott, Murphy & Presser

[57] ABSTRACT

A method of producing a composite diamond abrasive compact includes the steps of forming an unbonded assembly comprising a cemented carbide body, a layer of catalyst metal on a surface of the carbide body, a layer of carbide particles, alone or in admixture with other particles, on the catalyst metal layer, and a layer of diamond particles on the carbide layer and subjecting the unbonded assembly to conditions of elevated temperature and pressure at which diamond is crystallographically stable to form a composite diamond abrasive compact.

9 Claims, 1 Drawing Sheet

METHOD OF PRODUCING A COMPOSITE DIAMOND ABRASIVE COMPACT

BACKGROUND OF THE INVENTION

This invention relates to composite diamond abrasive compacts.

A composite diamond abrasive compact consists of a diamond compact bonded to a cemented carbide substrate or support. Such compacts are well known in the art and have been described extensively in the patent and other literature. They have also found wide commercial application.

Composite diamond abrasive compacts are generally manufactured by placing a layer of diamond particles on a cemented carbide body to form an unbonded assembly and then subjecting that unbonded assembly to elevated temperature and pressure conditions at which diamond is crystallographically stable. Cobalt from the carbide substrate infiltrates the diamond mass during the compact manufacture. In so doing, the carbide substrate is depleted of cobalt giving rise to stresses in the substrate. These stresses can lead to failure of the composite compact during use.

U.S. Pat. No. 3,745,623 describes a method of making a composite diamond abrasive compact. In one embodiment of the method, there is not a sharp transition from a carbide-cobalt powder mix (for the carbide substrate) to the diamond powder mix. Instead, a transition layer between the carbide-cobalt mass and the diamond layer may be provided, that transition layer containing both carbide-cobalt powder and diamond grit in a gradated mix to minimise stress concentrations.

U.S. Pat. No. 4,802,895 describes a method of making a composite diamond abrasive compact in which a thin layer of fine carbide powder is placed on a surface of a carbide body and a mass of fine diamond particles mixed with powdered cobalt placed on the layer of carbide powder. That unbonded assembly is then subjected to the usual conditions of elevated temperature and pressure to produce the composite diamond abrasive compact.

U.S. Pat. No. 4,311,490 describes a method of making a composite diamond abrasive compact in which the diamond mass consists of two layers, a coarse layer being closet to the catalyst metal, i.e. the cobalt, and a fine layer being disposed furthest away from the catalyst metal. The source of cobalt is the carbide substrate.

U.S. Pat. No. 4,403,015 describes a method of making a composite abrasive compact in which there is an intermediate bonding layer between the compact and the carbide substrate. This intermediate bonding layer comprises cubic boron nitride in an amount of less than 70 volume percent and the residual part principally consisting of a compound selected from among carbides, nitrides, carbonitrides or borides of IVa, Va, VIa transition metals of the Periodic Table, an admixture thereof, or a mutual solid solution compound thereof.

SUMMARY OF THE INVENTION

According to the present invention, there is provided a method of producing a composite diamond abrasive compact including the steps of forming an unbonded assembly comprising a cemented carbide body, a layer of catalyst metal on a surface of the carbide body, a layer of carbide particles, alone or in admixture with other particles, on the catalyst metal layer and a layer of diamond particles on the carbide particle layer and subjecting the unbonded assembly to suitable conditions of elevated temperature and pressure to form a composite diamond abrasive compact.

DESCRIPTION OF EMBODIMENTS

Figure 1:
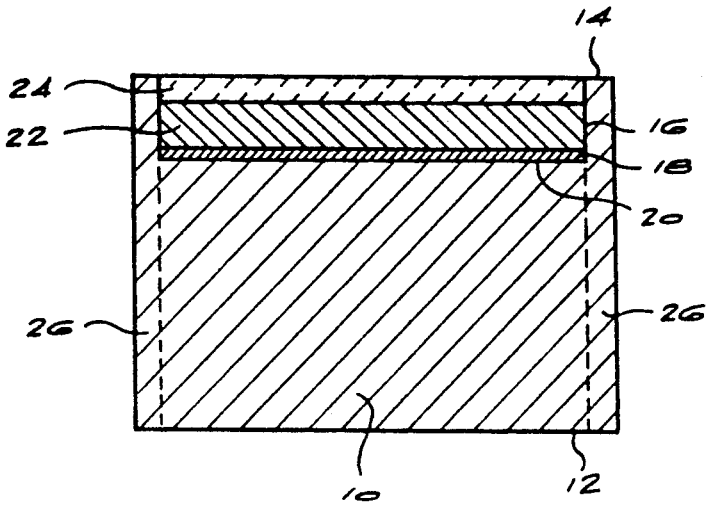
FIGS. 1 and 2 illustrate sectional side views of two unbonded assemblies useful in the practice of the invention.

The layer of catalyst metal may be provided in the form of a film, shim disc or powder. It is preferably provided in shim or disc form. The catalyst metal may be any known in the art, preferably nickel, cobalt or iron or an alloy containing one or more of these metals.

The particles of the carbide particle layer may consist of carbide particles alone or carbide particles in admixture with diamond, cubic boron nitride or like particles. The layer may be in particulate form or in bonded form with a non-metallic binder which can be volatilised.

The diamond layer may be in particulate or bonded form with a non-metallic binder which can be volatilised. The layer may contain other particles which do not adversely affect the formation of a diamond compact.

When the carbide particles and/or diamond particles are provided in bonded form, it is preferable that they are bonded by mixing the particles with a suitable organic binder, such as a cellulose, and sintering the mixture.

An embodiment of the invention will now be described with reference to the accompanying drawing. Referring to this drawing, there is shown a cemented carbide body 10 having a lower surface 12 and an upper surface 14. A recess 16 is formed in the upper surface 14.

Located in the recess 16 are three discrete layers. The first layer 18 is in contact with the surface 20 of the body 10 and is a cobalt shim. The second layer 22 is a layer of bonded carbide particles. The third layer 24 is a layer of bonded diamond particles.

The layers 22 and 24 are both formed by first mixing the particular particle with methyl cellulose and then heating that mixture to a temperature of the order of 100° C. to form a sintered mass. It is sintered mass which is then placed in the recess 16.

The unbonded assembly is heated to a temperature of about 300° C. This has the effect of driving off or volatilising the methylcellulose binder from layers 22, 24. The assembly is then placed in a reaction capsule. The loaded capsule is placed in the reaction zone of the high temperature/high pressure apparatus. The contents of the capsule are subjected to a temperature of 1500° C. and a pressure of 50 kilobars and these elevated conditions are maintained for a period of about 15 minutes. During this time, cobalt from the layer 18 infiltrates both the layers 22 and 24 producing in these layers cemented carbide and a diamond compact, respectively. Some infiltration of cobalt into the body 10 occurs. A strong bond is produced between the layers 22 and 24 and between the layer 22 and the body 10.

The bonded product may now be recovered from the reaction capsule using conventional techniques. The sides 26 of the body 10 may be removed, for example by grinding, to the dotted lines to produce a composite diamond abrasive compact.

The use of the discrete layers 18, 22 and 24 in the manufacture of the composite diamond abrasive compact has the significant advantage that the properties of the carbide body 10 and the sintered carbide layer 22 are closely matched in terms of thermal expansion coefficients. In addition, the action of the carbide layer 22 and the diamond compact sintering simultaneously, i.e. minimising bimetallic effects, results in a final product which displays significantly lower residual stress levels that a composite diamond abrasive compact made by conventional methods.

Figure 2:
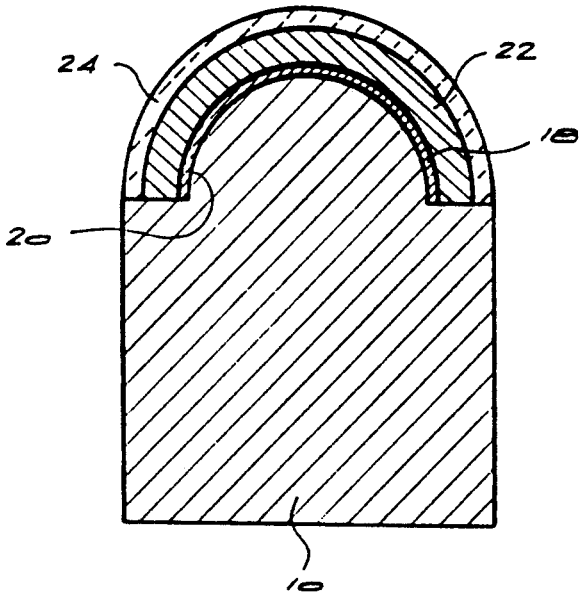

FIG. 2 illustrates a second embodiment of the invention in which a bullet-shaped composite diamond abrasive compact is produced. The method used is similar to that for the FIG. 1 embodiment and like parts carry like numerals. The unbonded assembly will be placed in a complementary shaped capsule for insertion into the reaction zone of a high pressure/high temperature apparatus.

We claim:

1. A method of producing a composite diamond abrasive compact includes the steps of forming an unbonded assembly comprising a cemented carbide body, a layer of catalyst metal on a surface of the carbide body, a layer of carbide particles, alone or in admixture with diamond particles, cubic boron nitride particles, or mixtures thereof, on the catalyst metal layer and a layer of diamond particles on the carbide particle layer and subjecting the unbonded assembly to suitable conditions of elevated temperature and pressure to form a composite diamond abrasive compact.

2. A method according to claim 1 wherein the layer of catalyst metal is provided in the form of a film, shim, disc or powder.

3. A method according to claim 1 wherein the catalyst metal is selected from nickel, cobalt and iron and alloys containing one or more of these metals.

4. A method according to claim 1 wherein the carbide particle layer is in particulate form.

5. A method according to claim 1 wherein the carbide particle layer is in bonded form with a non-metallic binder which can be volatilised.

6. A method according to claim 5 wherein the non-metallic binder is a cellulose.

7. A method according to claim 1 wherein the diamond layer is in particulate form.

8. A method according to claim 1 wherein the diamond layer is in bonded form with a non-metallic binder which can be volatilised.

9. A method according to claim 8 wherein the non-metallic binder is a cellulose.

* * * * *

UNITED STATES PATENT AND TRADEMARK OFFICE

CERTIFICATE OF CORRECTION

PATENT NO. : 5,248,317

DATED : September 28, 1993

INVENTOR(S) : Klaus Tank, et al.

It is certified that error appears in the above-indentified patent and that said Letters Patent is hereby corrected as shown below:

Column 1, line 46: "closet" should read as --closest--

Column 2, line 45: after "is" insert --this--

Signed and Sealed this

Twelfth Day of April, 1994

*Attest:*

Bruce Lehman

BRUCE LEHMAN

*Attesting Officer*

*Commissioner of Patents and Trademarks*